United States Patent [19]

Bowman et al.

[11] Patent Number: 4,805,403

[45] Date of Patent: Feb. 21, 1989

[54] ENGINE EXHAUST SYSTEM

[75] Inventors: Timothy J. Bowman, Bexley; Robert A. Marshall, Ilford; Trevor W. Biddulph, Maldon, all of United Kingdom

[73] Assignee: Ford Motor Company, Dearborn, Mich.

[21] Appl. No.: 131,975

[22] Filed: Dec. 11, 1987

[30] Foreign Application Priority Data

Dec. 23, 1986 [GB] United Kingdom ..... 8630706

[51] Int. Cl.[4] ..... F01N 3/04; F02N 17/06

[52] U.S. Cl. ..... 60/320; 60/278; 123/142.5 R; 123/179 H; 123/543; 123/557

[58] Field of Search ..... 60/320, 278; 123/543, 123/557, 179 H, 142.5 R

[56] References Cited

U.S. PATENT DOCUMENTS

| | | | |
|---|---|---|---|
| 2,323,639 | 7/1943 | Anderson | 123/543 |
| 4,086,763 | 6/1978 | Matsushita | 60/282 |
| 4,095,575 | 6/1978 | Wulf | 123/142.5 R |

*Primary Examiner*—Douglas Hart

*Attorney, Agent, or Firm*—Robert E. McCollum; Clifford L. Sadler

[57] ABSTRACT

An internal combustion engine has intake and exhaust ducts, including an exhaust duct portion formed as an integral part of the engine along with the engine coolant jacket and passages, the exhaust duct portion being located in good thermal contact with the engine coolant flow passages, and flow diverting valves in the exhaust duct portion to direct exhaust gases to flow through the exhaust duct portion when the engine is cold in order to accelerate warm-up, the valves causing the duct to be bypassed under normal operating conditions.

8 Claims, 2 Drawing Sheets

ENGINE EXHAUST SYSTEM

The present invention relates to an exhaust system for a liquid cooled engine of a motor vehicle.

According to the present invention, there is provided an internal combustion engine wherein an exhaust duct is provided in good thermal contact with the engine coolant, and flow diverting valves are provided to direct exhaust gases to flow through said exhaust duct when the engine is cold in order to accelerate warm-up, the valves causing the duct to be bypassed under normal operating conditions.

U.S. Pat. No. 4,391,235, Majkrzak, shows a system in which engine exhaust gases pass through a heat exchanger 32 to heat engine coolant in lines 38 and 40. Diverter valves control the flow. However, this system is entirely external to the engine. In contrast, the exhaust gas duct of the invention for heating the coolant is formed in the cylinder head in thermal contact with the coolant jacket. The duct may in this case be formed by bores extending along the length of the cylinder head.

The exhaust duct may include a branch in thermal contact with a part of the inlet manifold. This can assist cold operation by preheating the fuel and air. Such heating of the inlet manifold may not be necessary in the case of a fuel injected internal combustion engine.

The flow diverting valves may be controlled to prevent exhaust gases being diverted under certain operating conditions even if the engine is cold. For example, under high speed and/or high load the back pressure caused by diversion of the exhaust gas flow may be undesirable and the heat in the exhaust duct may prove excessive, especially for the intake manifold. However, a bypass passsage may be used to prevent excessive back pressure when the fast warm-up system is operational.

The flow diverting valves may conveniently be butterfly valves diverting the exhaust flow from any selected ones of the cylinders through the exhaust duct. It is not essential to divert all the exhaust gases and in the case of a four-cylinder engine, it is most practicable to divert the flow from only the middle two cylinders in the block.

If desired, an EGR (exhaust gas recirculation) takeoff may be formed in the exhaust duct as it provides a convenient location where exhaust gases are available in close proximity to the inlet manifold.

Increased back pressure does occur, as earlier mentioned, when the exhaust gases are diverted through the duct. To compensate for the greater concentration of exhaust gases which will now be present in each fresh charge, it is possible to advance the ignition. Where the gases from only selected cylinders are diverted, then only the ignition of the affected cylinders need be advanced.

The exhaust system of the invention thus allows the heat of the exhaust gases to be recirculated to the water jacket, and if desired also to the oil, during the warm-up, thereby reducing warm-up times. For motor vehicles used frequently for short journeys, this reduces overall fuel consumption as the cold operation normally requires richer fuel mixtures, this making for less economical operation. Fast warm-up also improves passenger comfort, as the heater cannot operate properly until the engine reaches its normal operating temperature.

The invention will now be described further, by way of example, with reference to the accompanying drawings, in which.

Figure 1:
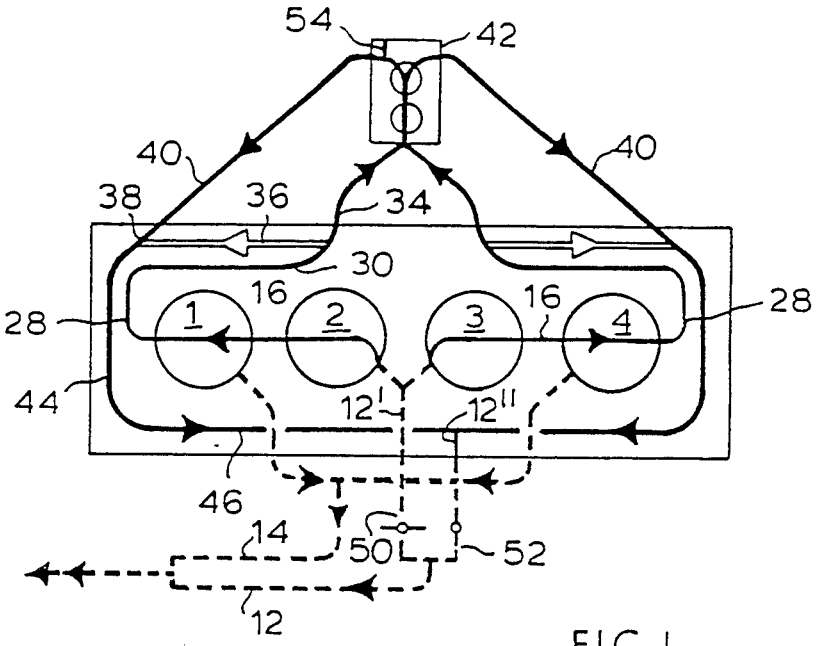
FIG. 1 is an exhaust gas flow chart for an engine with a bifurcated exhaust.

FIG. 1 illustrates schematically a plan view of a four-cylinder internal combustion engine. The exhaust ports of cylinders 1 and 4 are connected by the dotted lines shown to one branch 14 of the exhaust manifold while the exhaust ports of cylinders 2 and 3 are connected by the dotted lines 12' to the second branch 12 of the exhaust manifold. The two branches 12 and 14 of the exhaust manifold are later connected to one another and to the exhaust pipe as indicated. This is a known and commonly used layout of an exhaust system for a four-cylinder engine.

Figure 2:
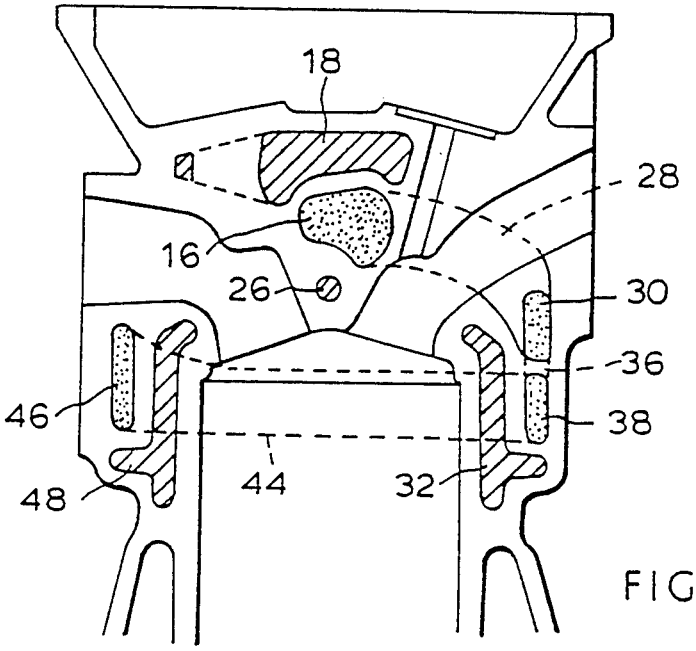
FIG. 2 is a schematic vertical partial section through a monoblock engine showing a configuration embodying the invention.
Figure 3:
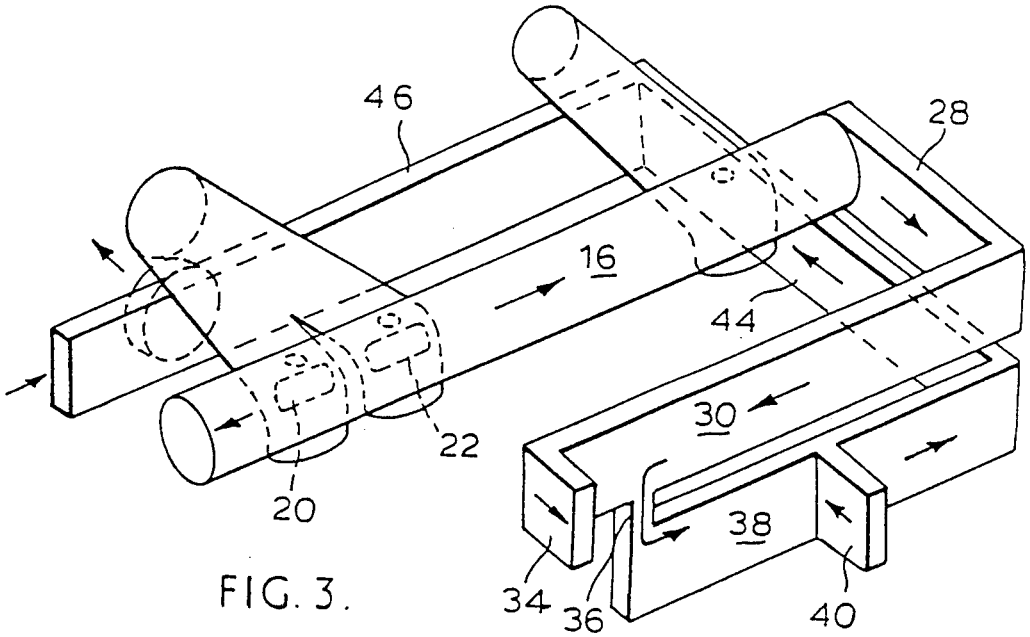
FIG. 3 is a partial schematic three dimensional representation of the exhaust system of FIG. 2.

In order to improve warm-up times, the exhaust gases from cylinders 2 and 3 can be diverted to heat the engine coolant. To achieve this, the exhaust ports 20, 22 (see FIG. 3) of these two cylinders are connected to an exhaust duct 16 (FIGS. 1, 2 and 3) which runs the length of the cylinder head. As seen in FIG. 2, the duct 16 is integral with the cylinder block and lies between two water passages 18 and 26 used to cool the tops of the cylinders. To enable the different passages in the cylinder block to be distinguished from one another more readily, in FIG. 2, water passages for the coolant have been diagonally shaded while the exhaust ducts are filled with dots.

At each end of the cylinder block, the duct 16 is connected by a transverse passage 28 (see FIGS. 1-3) to an upper exhaust duct 30 which extends parallel to a water jacket passage designated 32 in FIG. 2. The exhaust duct 30 leads to an external connection 34 for the inlet manifold 42. It also is connected through a bypass passage 36 directly to a return exhaust duct 38 which, as best seen from FIG. 3, extends parallel to and beneath the duct 30. Return lines 40 from the inlet manifold 42 also lead to the return duct 38.

At the ends of the cylinder block, the return duct 30 is connected by two (see FIG. 1) transverse passages 44 to a further duct 46 formed in the cylinder block and extending down the other side of the block (see FIG. 2) in close proximity to a passage 48 of the water jacket.

Returning to FIG. 1, as stated previously, the exhaust ports of cylinders 2 and 3 are connected to the inlet manifold 42 through a first one 12' of two branches, of which the other 12" is connected to the exhaust return duct 46. Each of the two branches 12' and 12" contains a valve indicated at 50 and 52, respectively. The two valves 50, 52 may, for example, be butterfly or flat valves and they are interconnected to operate so that when one closes, the other opens.

The valves 50, 52 may be controlled electronically or mechanically and act to divert the exhaust gases in order to increase the heating of the water jacket. thus, when the engine is cold, the valve 50 is closed and the valve 52 opened, as shown in FIG. 1. In this position of the valves, the exhaust gases from cylinders 2 and 3 cannot flow out directly through branch 12' into the exhaust manifold, but instead are diverted through lines 16, 34, 40, 38, 44 and 46 to follow the path indicated by arrows in FIGS. 1 and 3.

More particularly, with valve 50 closed, the exhaust gases first flow through the duct 16 towards the ends 28 of the block. This brings the gases into good thermal contact with the water passages 18 and 26 (see FIG. 2). Next, after turning around at the ends of the cylinder block, the gases flow through the ducts 30 and heat the water in the coolant passage 32. At this point, some of the gases return to the exhaust pipe through bypass 36 while some pass through the inlet manifold 42 to heat the intake air so as to improve atomization of the fuel. At this point, a tap 54 is also available for EGR, if required.

The gases passing through the inlet manifold 42 flow through line 40 to return duct 38 to again heat the passage 32. After passing around the ends of the cylinder block, the gases flowing through the duct 46 heat the water in passage 48 before passing into the exhaust system through the line 12', past return valve 52, and line 12'.

It can be seen that throughout the diversion, the exhaust gases pass through ducts which are in close proximity to passages of the water jacket, so that the coolant water is heated more rapidly and combustion is assisted by the heating of the intake manifold. It may not be necessary to subject the intake manifold to the full heating effect of the exhaust gases, and the extent of heating can be requlated by a suitable dimensioning of the bypass lines 36.

Once the engine has reached its normal operating temperature, the diversion of the exhaust gases is no longer required and valve 50 now can be opened and valve 52 closed. In these positions, the gases take the path of least resistance and flow directly into the exhaust manifold unimpeded whereas flow of gases through duct 16 is prevented due to the back pressure caused by the closing of valve 52.

Because of the increased back pressure as a result of closing of the valve 52, a greater volume of exhaust will be present in each fresh charge to those cylinders supplying the fast warm-up system. This can, however, be taken into account when igniting the mixture and preferably the ignition in the affected cylinders is advanced while the exhaust flow is being diverted.

The system described above diverts only the flow from the exhaust of the two cylinders 2 and 3. Though diverting the flow from four cylinders would be expected to provide still more rapid warm-up times, the design is more difficult to achieve and may interfere with the efficiency of the engine.

The valves 50 and 52 may be formed in the cylinder head or cylinder block. As an alternative, a separate unit containing the two valves may be inserted between the cylinder head of block and the exhaust manifold.

The control of valves 50 and 52 may take into consideration factors other than operating temperature. In particular, if the engine is operating under high load or at high speed, the back pressure resulting from the diversion of the exhaust gases may be undesirable.

Figure 4:
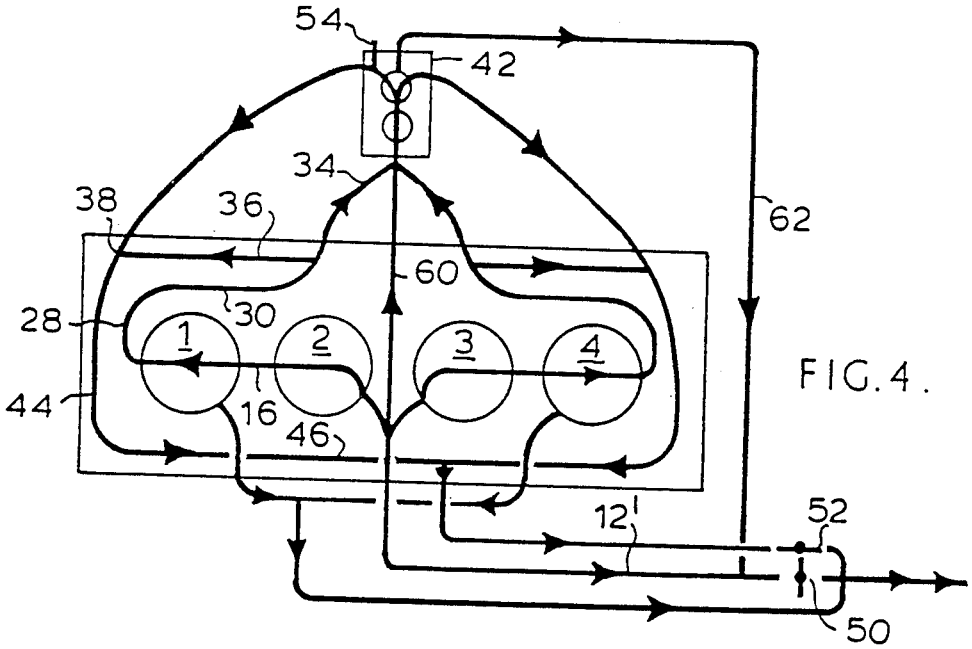
FIG. 4 is an exhaust gas flow chart similar to that of FIG. 1 for an engine having a bifurcated exhaust heated manifold, and a continuous exhaust flow to the manifold hot spot for fuel evaporation and charge heating under stabilized conditions.

The system of FIG. 4 shows an alternative construction. It differs from that of the previous figures in that a further passage 60 is included to extend across the cylinder block from the exhaust ports of cylinders 2 and 3 directly to the intake manifold 42. It returns to the exhaust system via an additional external pipe 62 to a point in the branch 12' of the exhaust manifold upstream of the diverting valve 50. The junction between the pipe 62 and the exhaust manifold 12' may include a venturi to decrease the pressure in line 62 and thereby promote flow through the path defined by the passage 60 and the pipe 62 when the main exhaust flow is not diverted upon opening valve 50.

In this case, when the valve 50 is closed to divert the exhaust gases, the intake manifold will be heated by the diverted gases but not by gases in the passage 62, since now the venturi in line 62 wil have no effect. On the other hand, when the valve 50 is opened, the coolant ceases to be heated by diverted gases in line 16, but the intake manifold will continue to be heated by the gases in passage 60. In other words, the intake manifold is permanently heated by exhaust gases. The configuration is particularly convenient to implement as the exhaust manifold can pass close to the intake manifold and the pipe 62 can be formed by a short riser extending between the two manifolds.

The heating of the intake manifold reduces volumetric efficiency and can decrease maximum power output. However, the heating improves atomization and can improve fuel consumption and emissions at part throttle conditions.

What is claimed:

1. An internal combustion engine having intake ducts, at least one exhaust duct and coolant flow passages, a portion of the exhaust duct being located in good thermal contact with the engine coolant, the exhaust duct including flow diverting valves operable at times to direct exhaust gases to flow through said exhaust duct portion when the engine is cold to warm the latter duct to accelerate engine warm-up, the valves at other times being operable to cause the duct portion to be bypassed under normal operating conditions, the exhaust duct portion being formed as an integral part of the cylinder head in thermal contact with a coolant flow passage therein.

2. An engine as claimed in claim 1, wherein the exhaust duct portion includes a bore extending along the length of the cylinder head.

3. An engine as claimed in claim 1, wherein the exhaust duct portion includes a branch in thermal contact with a part of the intake duct.

4. An engine as claimed in claim 1, wherein the flow diverting valves are operable to prevent the diversion of exhaust gases at times even when the engine is cold.

5. An engine as claimed in claim 1, wherein the flow diverting valves in the exhaust duct portion are butterfly valves.

6. An engine as claimed in claim 1, wherein the exhaust duct portion contains exhaust flow from only selected ones of the engine cylinders.

7. An engine as claimed in claim 1, wherein an exhaust gas recirculation (EGR) passage is connected to the exhaust duct portion.

8. An engine as claimed in claim 6, wherein the ignition is advanced of the cylinders from which the exhaust gases are diverted through the exhaust duct portion.

* * * * *